US011702727B2

(12) United States Patent
Fuentevilla Diaz

(10) Patent No.: US 11,702,727 B2
(45) Date of Patent: Jul. 18, 2023

(54) METHOD FOR OBTAINING ROLLING MILL ROLLS WITH A COATING OF TUNGSTEN CARBIDE ALLOY, AND RESULTING ROLL

(71) Applicants: MECANIZACION INDUSTRIAL ASTILLERO, S.A., Cantabria (ES); Gregorio Fuentevilla Diaz, Cantabria (ES)

(72) Inventor: Gregorio Fuentevilla Diaz, Cantabria (ES)

(73) Assignee: MECANIZACION INDUSTRIAL ASTILLERO, S.A., Cantabria (ES)

( * ) Notice: Subject to any disclaimer, the term of this patent is extended or adjusted under 35 U.S.C. 154(b) by 0 days.

(21) Appl. No.: 17/788,609

(22) PCT Filed: Jan. 15, 2021

(86) PCT No.: PCT/ES2021/070016

§ 371 (c)(1),
(2) Date: Jun. 23, 2022

(87) PCT Pub. No.: WO2021/148690

PCT Pub. Date: Jul. 29, 2021

(65) Prior Publication Data

US 2023/0042220 A1 Feb. 9, 2023

(30) Foreign Application Priority Data

Jan. 20, 2020 (ES) ..... ES202030039

(51) Int. Cl.
*C23C 4/129* (2016.01)
*B21B 27/02* (2006.01)
(Continued)

(52) U.S. Cl.
CPC ..... *C23C 4/129* (2016.01); *B21B 27/02* (2013.01); *C23C 4/02* (2013.01); *C23C 4/10* (2013.01)

(58) Field of Classification Search
CPC .. C23C 4/129; C23C 4/02; C23C 4/10; B21B 27/02
See application file for complete search history.

(56) References Cited

U.S. PATENT DOCUMENTS 4,794,680 A * 1/1989 Meyerhoff ..... D02G 1/12 219/121.72
4,872,904 A * 10/1989 Dorfman ..... C22C 1/051 75/352

(Continued)

FOREIGN PATENT DOCUMENTS

CN 104611664 A 5/2015
CN 106011605 A 10/2016

(Continued)

OTHER PUBLICATIONS

International Search Report or corresponding PCT application No. PCT/ES2021/070016, dated Mar. 17, 2021.

(Continued)

*Primary Examiner* — Jason L Vaughan
(74) *Attorney, Agent, or Firm* — Notaro, Michalos & Zaccaria P.C.

(57) ABSTRACT

The method for obtaining rolling mill rolls with a coating of tungsten carbide or the alloy thereof, wherein the coating is a single layer and is carried out by high velocity thermal spraying is disclosed.

6 Claims, 2 Drawing Sheets

(51) Int. Cl.
*C23C 4/02* (2006.01)
*C23C 4/10* (2016.01)

(56) References Cited

U.S. PATENT DOCUMENTS 5,902,942 A * 5/1999 Maderud ..... B22F 1/18 419/33
6,372,346 B1 * 4/2002 Toth ..... C09K 3/1445 428/404
7,293,445 B2 * 11/2007 Lev ..... B21B 13/00 72/262
7,736,582 B2 * 6/2010 Toth ..... C04B 35/628 264/642
8,105,692 B2 * 1/2012 Dumm ..... C23C 30/00 428/408
8,308,096 B2 * 11/2012 Mirchandani ..... B02C 4/305 241/293
9,186,726 B2 * 11/2015 Keane ..... B22F 1/18
9,403,342 B2 * 8/2016 Watanabe ..... C23C 24/08
2007/0137038 A1 * 6/2007 Barr ..... C25D 7/0657 29/895
2009/0191416 A1 * 7/2009 Verstak ..... C23C 4/129 428/457

FOREIGN PATENT DOCUMENTS

CN 106040744 A 10/2016
CN 108842125 A 11/2018
CN 109023365 A 12/2018
CN 2091128522 U 7/2019
CN 107699842 B 8/2019
EP 0694620 A1 1/1996

OTHER PUBLICATIONS

Written Opinion or corresponding PCT application No. PCT/ES2021/070016, dated Nov. 8, 2021.
International Preliminary Report on Patentability for corresponding PCT application No. PCT/ES2021/070016, dated Jan. 18, 2022.

* cited by examiner

METHOD FOR OBTAINING ROLLING MILL ROLLS WITH A COATING OF TUNGSTEN CARBIDE ALLOY, AND RESULTING ROLL

OBJECT OF THE INVENTION

The object of the present invention is to develop a process from which rolling mill rolls can be obtained with a coating of tungsten carbide alloy wherein the coating is a single layer.

Coating is carried out by means of thermal spraying.

The invention provides for obtaining mill rolls with both smooth and rough finishes, another object of the invention being to reduce the generation of dirt on the coatings generated by the process itself.

Therefore, the present invention falls within the scope of coated rolling mill work rolls.

BACKGROUND OF THE INVENTION

In the production of rolled steels, rolling mill rolls are used. Its function is important not only from the point of view of productivity but also from its great influence on surface quality.

The mill work rolls are those that are in contact with the strip to be rolled, either to reduce the thickness (reduction mills) or to give the finish and mechanical properties to the rolled material. Due to the strip-mill roll contact, the latter wears on the surface and loses the surface finish and geometric profile thereof. When this happens the mill rolls must be replaced by others.

Historically, mill rolls were used uncoated and were made of cast steel and became forged steel to increase wear resistance over a greater number of rolled tonnes.

In the 1980s, the first coating tests were carried out on forged steel mill rolls with different coatings, electrolytic chromium being the one that obtained the best results in terms of the combination of wear resistance and price. Chromium is currently the globally accepted and established coating for most rolling companies.

In Europe, due to environmental restrictions, the electrolytic process of chromium obtained from highly toxic hexavalent chromium will be banned. After several moratoriums, the EEC has decided to suspend this process in 2023, so that producing companies will have to look for environmentally viable alternatives in accordance to REACH. This implies that companies that use chromium in their processes are looking for alternatives for replacement before 2023. This is the case of rolling companies that, through their R&D departments, are testing new coatings that are technically, economically and environmentally true alternatives to chromium.

Documents such as those described below are known in the state of the art:

Patent CN107699842B describes a non-metallic rolling process wherein the applied compression forces are very low compared to the steel rolling process. Coating thicknesses in this application of 0.15±0.1 mm have already been shown not to work in steel rolling mills, causing premature skipping of the supplied layer. Although they use HVAF technology, they are not capable of applying low thickness layers that are suitable for our application and that are sufficiently proven.

Patent EP0694620 exhibits the same difficulties as the previous patent.

Document CN106011605 aims to manufacture a ring by means of powder alloy sintering hardened and subsequently welded to the mill roll body.

Consequently, it is not a coating but the manufacture of hardened sleeves, a process that is not applicable to flat (hot and cold) rolling mill rolls. More specifically, these rings are set on a roller body and are used for rolling long products: wire rod, billet. Due to the manufacturing complexity thereof, the size of these rings is very small and they are not dimensionally useful in the hot and cold rolling of flat products (sheet metal), exhibiting thicknesses that are in the range of mm, and able to range from 30-150 mm.

These rings do not resist the rolling forces applied in the hot and cold sheet metal rolling mills, exhibiting a very low conductivity and due to the great thickness they would not dissipate the heat produced in the rolling gap causing frequent changes, not being technically and economically operational.

Document CN 2091128522 consists of a general process of spraying Tungsten Carbide on corrugated rollers that are used for manufacturing corrugated cardboard, not being applicable in cold and hot metal rolling.

More specifically, the tungsten carbide thicknesses are above 0.030 mm and they would not withstand the metal rolling forces, so that the coating would detach, to which the fact must be added that in this process several passes of coating application are required.

Document CN106040744 describes a process in which a layer of Tungsten Carbide is applied by means of a hardening process, in which Carbon and Tungsten are introduced in a furnace, depositing a layer of Tungsten carbide and increasing the carbon concentration in the mill roll body.

The hardening process is carried out at temperatures above 920° C.

In order to deposit Tungsten Carbide using this technique, it is necessary to carry out a surface engraving (with laser) to be able to guarantee the adhesion of the deposited layer.

This technology cannot be applied to cold rolling work mill rolls since they exhibit a layer of Martensitic structure (20-25 mm thick) that will be destroyed at hardening temperatures. This structure confers a hard layer to the mill rolls that supports the HVAF coating and reduces the deformation of the mill roll under the working conditions in cold rolling mills, reducing the useful life of the mill roll.

Due to the hardening temperatures, the mill rolls would not admit recovery since the mill roll sleeves would deform, making them unusable. Therefore, this application would only be for newly manufactured mill rolls. This problem would also occur in hot rolling mill rolls.

The reality is that the price of new hot and cold sheet metal rolling mill rolls is very high, so this process would not be economically viable if they cannot be reused.

At the same time, the laser engraving that is necessary to carry out with this technology would not be usable in cold rolling, since, due to rolling pressures, the rolled product would be marked, rendering it unusable.

Furthermore, the increase in carbon concentration during hardening will increase the brittleness of the mill roll, so that changes and defects of material detachment from the mill roll due to thermal cracks caused under hot rolling conditions will not be reduced.

Moreover, at the temperatures of the hot rolling process (>400° C.), this Tungsten Carbide coating would not be viable (already tested) since it loses hardness when exceeding 400° C., decreasing wear resistance.

In short, it is an economically unviable process in the logistics conditions of hot and cold rolling given the long time that this technology requires to process a mill roll.

Document CN 104611664 describes a general process for depositing Metal-ceramic (Tungsten Carbide, etc.) on rolling mill rolls, which is not applicable to cold rolling mill work rolls.

This technology is applicable to bridle, tension, guide rollers, etc., currently in use around the world. The difference in this technique is based on the application by means of spraying an initial layer of Ni—Al (0.02 mm) to improve corrosion resistance, since its technology creates porous layers. Subsequently, a 0.15-0.20 mm thick layer of Cermet is applied and finally, as this layer is still porous, an organic sealant (pore cover) is applied and subsequently cured.

Thus, it is a classic technology for rollers used for rolling, but not for the work rolls of rolling mills.

More specifically, the thicknesses applied are extremely high (total 0.17-0.22 mm) so that this layer would detach when the first meter of sheet metal is rolled (already tested).

At the same time, to apply the thickness described, it is necessary to carry out more than four passes, so that more stresses will be generated in the coating, which will cause detachment during rolling.

Furthermore, during the ultrasonic spraying process, a high porosity and brittleness is generated in the coating due to the high content of oxygen necessary for combustion.

Therefore, as can be seen from the documents of the state of the art, although they have a tungsten carbide coating, they exhibit some drawbacks. In most cases, the thicknesses of the coatings are very high, or they are processes that are not applicable to rolling mill rolls, and that in case of being applied to steel rolling mills they cause premature skipping of the supplied layer and therefore are not suitable for cold rolling, while, on other occasions, they use two layers of coating or are rollers wherein a much lower compression force is required.

Consequently, the object of the present invention is to develop a surface coating on the work mill rolls of the rolling process, improving the performance in the rolling mills and at a price similar to that of chromium plating.

DESCRIPTION OF THE INVENTION

The proposed method solves in a fully satisfactory way the problems previously exposed.

For this, and more specifically, the following operational phases are envisaged in the method of the invention:

a) degreasing the surface of the mill roll;

c) heating the surface of the mill roll;

d) coating the mill roll with a tungsten carbide alloy or alloys thereof by means of thermal spraying wherein a powder of a tungsten carbide alloy is melted exhibiting a powder granulometry comprised between 30 μm and 5 μm in a combustion chamber, the molten material is transported to a spraying gun by means of a carrier gas and is sprayed on the mill roll by means of the gun with a supply flow at values comprised between 1 and 8 kg/h.

The initial degreasing step a) removes the remains of oils and fats from the surface of the mill roll.

The heating step c) serves to carry out a previous preheating so that the surface of the mill roll can admit the subsequent coating without producing thermal shocks that will cause an increase in the permeability and cracking of the supplied layer.

The thermal spraying step d) is the step wherein the mill roll is coated with the appropriate material, thickness and mechanical properties. The material to be sprayed is partially or totally melted in the combustion chamber. This molten material is accelerated at the nozzle of the gun and thrown at high speed onto the surface of the mill roll.

Tungsten carbide alloy granulometries greater than 30 μm induce an increase in permeability and a decrease in impact resistance, causing detachment failures of the supplied layer during the rolling process. Flows greater than 8 Kg/h produce an increase in the thickness of the coating, an increase in stresses and an increase in the deposition of the powder in the gun.

In the case of requiring a smooth finish (for sheet metal and tin plate rolling), an additional step of conventional polishing is added, with diamond abrasive to reduce the roughness to the values that are necessary.

In the case of requiring a rough finish, the method optionally envisages a step b) for activating the surface by means of technical blasting, so that this step removes the remains of oils and fats. This blasting operation will be carried out with controlled roughness in hot or cold with the same spraying gun using an aluminium oxide.

Another option to obtain rough finishes in which cleaning is important is to skip this step b), so that after step d) two new steps are added.

In a step e) a surface cleaning process is carried out by means of heating, similar to step c), a step that aims to remove the dirt produced in step d) of thermal spraying of the tungsten carbide alloy.

In a step f), the roughness peaks are rounded by spraying glass beads. This phase reduces friction.

Everything is carried out with the same spraying gun.

From any of these three variants of the method, rolling mill rolls coated with a tungsten carbide alloy are obtained, with a low thickness coating, wherein the coating is a single layer, with a thickness comprised between 0.003 mm and 0.020 mm, and affecting 100% of the work surface.

Measurement of the coating thickness is determined by means of the ASTM-B499 Standard.

In this sense, it is worth highlighting the fact that achieving a coating of the rolling mill rolls with tungsten carbide or the alloys thereof in a single layer and with a thickness comprised between 0.003 mm and 0.020 mm is not a mere design and/or manufacturing option, since under normal conditions, the application of layers with thicknesses less than 0.020 mm produces a very low coverage of the coating on the working mill roll, leaving partially uncovered areas with high permeability, which causes a detachment of this layer. For this reason, one second or more layers are applied to guarantee 100% coverage of the work surface, this makes the thickness that is reached greater than 0.020 mm which does not withstand the rolling conditions due to the thickness and the inclusion of internal stresses in the next applied layers. Due to these stresses, micro-cracking of the supplied layer is caused under the rolling stresses and consequently failure in the coating will be achieved, skipping the layer. This does not happen in the mill roll of the invention.

The advantages of the mill roll of the invention is that it increases the lifetime (wear limit) of the mill rolls by a factor greater than 2 with respect to chromium-plated mill rolls and by a factor greater than 3 with respect to uncoated mill rolls, it increases the times of the rolling campaign, it reduces the total annual consumption of mill rolls, and it represents the possibility of not having to schedule continuous rolling campaigns and being able to carry out changes of width in progress.

The mill roll obtained exhibits hardness greater than 1300 HV to guarantee excellent wear resistance due to sheet metal-mill roll friction and permeabilities of less than 0.1% to withstand the high compression forces of the rolling process of 0.8 to 3 Tm/mm.

Permeability is measured by means of the gas permeability test. Hardness is measured by means of the ASTM-B578 Standard.

Except when indicated otherwise, all of the technical and scientific elements used in this specification have the meaning commonly understood by a person with average skill in the art to which this invention belongs. When this invention is put into practice, methods and materials may be used that are similar or equivalent to the ones described in the specification.

Throughout the description and the claims, the word "comprise" and its variants are not intended to exclude other technical features, additions, components or steps. For those skilled in the art, other objects, advantages and features of the invention will be deduced from both the description and the practical use of the invention.

DESCRIPTION OF THE DRAWINGS

As a complement to the description that will be provided herein, and for the purpose of helping to make the features of the invention more readily understandable, according to a preferred practical exemplary embodiment thereof, said description is accompanied by a set of drawings constituting an integral part thereof in which, by way of illustration and not limitation, the following is represented:

FIG. 10 is the cross section of the tungsten carbide coating applied by means of high velocity air fuel spraying technology object of the invention.

PREFERRED EMBODIMENT OF THE INVENTION

Figure 1A:
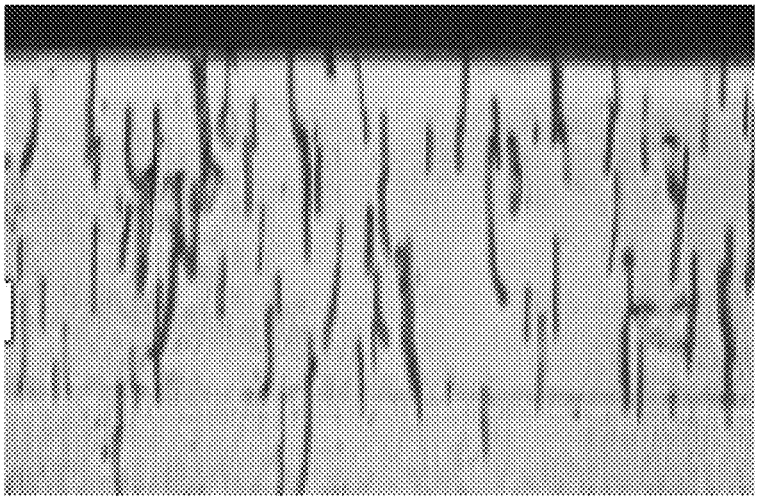
FIG. 1A shows a cross section of a chromium coating currently in use.
Figure 1B:
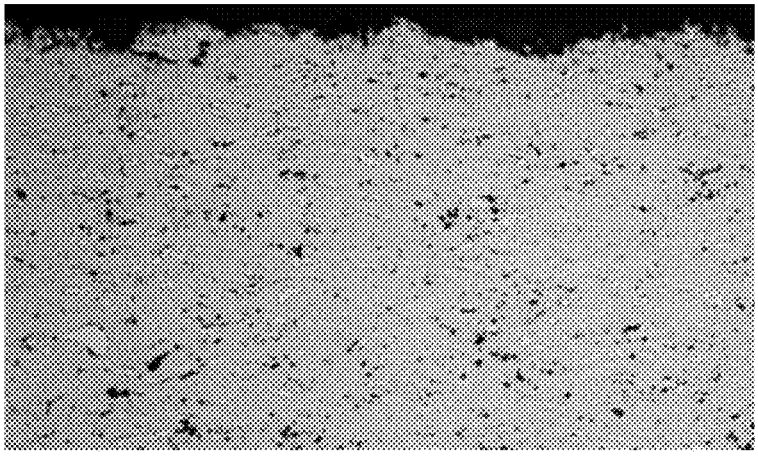
FIG. 1B shows the cross section of a typical tungsten carbide coating applied by means of high velocity oxygen fuel spraying technology.
Figure 1C:
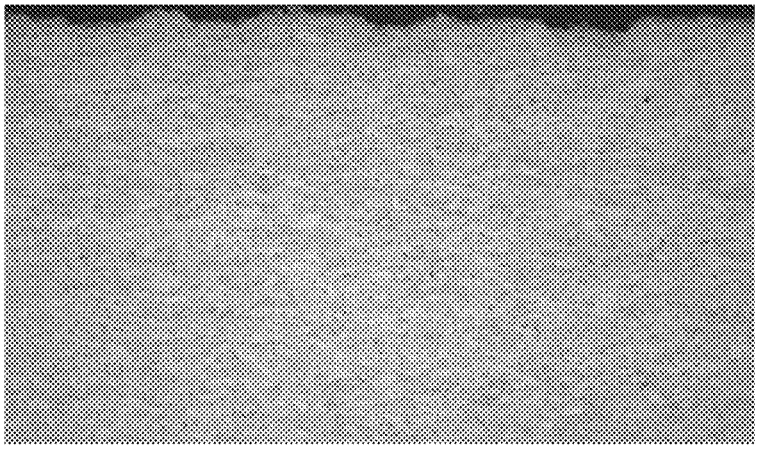

In accordance with any of the variant embodiments of the method of the invention, the following operational steps are established in all of them:

a) degreasing the surface of the mill roll;

c) heating the surface of the mill roll;

d) coating the mill roll with a tungsten carbide alloy or alloys thereof by means of thermal spraying wherein a powder of a tungsten carbide alloy is melted exhibiting a powder granulometry comprised between 30 μm and 5 μm in a combustion chamber, the molten material is transported to a spraying gun by means of a carrier gas and is sprayed on the mill roll by means of the gun with a supply flow at values comprised between 1 and 8 kg/h.

Preferably step a) is carried out by using cold solvents or vapor phase.

Preferably, the temperature of step c) should be similar to the temperature that the mill roll will reach during the thermal spraying process, and it will be a function of the mass of the mill roll to be coated. In particular, for mill rolls with a diameter greater than 500 mm, the temperature must be comprised between 40-50° C. In particular for mill rolls with a diameter of less than 500 mm, the temperature should be 80-100° C. In particular, the heating is carried out with a combustion flame.

When the rolling mill roll to be obtained is intended to have a smooth finish, (0.2 to 0.4 microns), a final polishing operation is carried out, in the same spraying machine and/or external machine. The polishing is carried out in a revolution machine using a diamond abrasive to reduce the roughness that comes out of the spraying and achieve the specified values.

It is an operation that is carried out dry (without coolant) with the following parameters:

rotation revolutions of the mill roll: 50-100 rpm

Travel speed of the abrasive strip: 20-60 cm/min

Type of abrasive: diamond

Abrasive grit size: 150-250 μm

Strip type: fiber with copper inserts for natural cooling.

According to a second variant embodiment of the invention, to obtain a rough finish the method comprises a step b) for activating the surface by means of technical blasting. This step removes the remains of oils and fats. This blasting operation will be carried out with controlled roughness in hot or cold with the same spraying gun using an aluminium oxide.

The blasting step ensures a coating adhesion of over 80%. The ASTM-B571 Standard is used for the qualitative determination of the adhesion of the coating.

More specifically, in step d) thermal spraying is materialised in high velocity air fuel thermal spraying. Preferably, the air pressure is in a range comprised between 586 and 621 kPa. In particular, the fuel is propane. Preferably, the propane pressure is in a range comprised between 600 and 634 kPa; furthermore, in particular, the propane pressure is at least 14 kPa above air pressure.

Preferably, the carrier gas is nitrogen. Preferably, the nitrogen flow rate is comprised between 20 l/min and 30 l/min. More preferably, between 23 l/min and 24 l/min.

Preferably, spraying by gun is carried out in the presence of hydrogen. Preferably, the hydrogen flow rate is comprised between 30 l/min and 40 l/min. More preferably, between 33 l/min and 36 l/min.

Preferably, the distance between the gun and the mill roll to be coated is comprised between 19 cm and 26 cm. Preferably, the powder has a granulometry comprised between 30 μm and 15 μm. Preferably, the supply flow is comprised between 4-8 Kg/h.

Preferably, the transverse speed of the spraying gun is comprised between 2 and 3 mm/s. When several layers of coating are applied, these speeds cannot be used since it causes the part to overheat, inducing thermal stress. Preferably, the linear movement of the mill roll in mm/s is at a speed of between 2000 and 3000 mm/s. In particular, 2000 mm/s is used for diameters less than 500 mm and 2500 mm/s is used for diameters comprised between 200 mm and 500 mm and 3000 mm/s is used for diameters less than 200 mm.

A second option when intending to obtain a rough finish, in which cleaning is important, consists of omitting step b) described above, so that after step d) two new steps are added.

In a step e). a carbide fines cleaning process is carried out by means of a reducing flame, introducing hydrogen in the combustion. If hydrogen is not introduced, the flame would be oxidising and would cause partial oxidation of the coating, causing the following situations:

Decarburisation: decrease in the content (%) of the useful Carbide phase, WC, another undesirable very brittle $W_2C$ phase being formed, reducing the wear resistance of the coating.

Increase in natural porosity due to the higher oxygen content in the combustion.

In this step, air pressure will preferably be comprised between 552 and 579 kPa, propane pressure between 593 and 614 kPa, while those of nitrogen, hydrogen and the combustion chamber will be set around 496 kPa, using a nitrogen flow rate of the order of 23 l/min, and a hydrogen flow rate of the order of 15 l/min.

In a step f), the peaks are rounded by means of a spraying gun without using a flame, only the set air pressure. The spraying material are glass beads of lower hardness than the coating so as not to erode it. The pressure of the bundle of glass beads causes a plastic deformation in the peaks of the roughness, causing the rounding. Roughness tends to decrease, so it is necessary to start from a roughness that is 10% higher in order to achieve the target roughness.

In this step, air pressure will preferably be comprised between 483 and 552 kPa, while the combustion chamber will be kept at a pressure of the order of 262 kPa.

As for the glass microspheres, they will have a composition based on sodium-calcium glass without free silica and chemically neutral, with a spherical and regular shape, non-porous, with a hardness comprised between 48-50 HRc and a granulometry comprised between 45-90 μm.

From this process, it is possible to reduce the dirt on the strip, obtaining a profile of the coating with more rounded peaks, which friction less with the sheet metal, reducing the number of iron fines on the strip.

In any of the three cases described above, a rolling mill roll is obtained with a coating of tungsten carbide alloys wherein the coating is a single layer, with a thickness comprised between 0.003 mm and 0.020 mm, affecting 100% of the work surface.

Preferably, the permeability of the coating is in a range between 0% and 0.1%.

The alloy is preferably selected from: WC—CoCr, WC—NiCr, WC—Co, WC—Ni, WC—CrC—Ni, WC—CrC—Co, tungsten carbide and molybdenum boride alloy (e.g., WC—Mo B Ni Co Cr Fe).

Preferably, the tungsten carbide alloy comprises chromium carbides.

Preferably, the tungsten carbide alloy comprises molybdenum borides. These alloys with MoB in the composition exhibit a superior non-stick property than WC alloys.

The coating layer has final properties such as those described below:

| | |
|---|---|
| Thickness, mm | 0.003-0.012 mm |
| Hardness, Hv | 1300-1600 Hv |
| Permeability, % | <0.1% |
| Young's modulus, GPa | ~450 GPa |
| Adhesion, MPa > | 80 |
| No. of passes: | 1 |

Having thus adequately described the nature of the present invention, as well as how to put it into practice, it must be noted that, within its essential nature, the invention may be carried out according to other embodiments differing in detail from that set out by way of example, which the protection sought would equally cover, provided that the fundamental principle thereof is not altered, changed or modified.

The invention claimed is:

1. A method for obtaining rolling mill rolls with a coating of tungsten carbide alloy, characterised in that the following operational phases or steps are defined therein:

a) degreasing the surface of the mill roll c) heating the surface of the mill rolls with a diameter greater than 500 mm between 40-50° C. and the mill rolls with a diameter of less than 500 mm between 80-100° C.

d) coating the mill roll with a tungsten carbide alloy comprising molybdenum borides or chromium carbides by means of thermal spraying wherein a powder of a tungsten carbide alloy is melted exhibiting a powder granulometry comprised between 30 μm and 15 μm in a combustion chamber, the molten material is transported to a spraying gun by means of a carrier gas and is sprayed on the mill roll by means of the gun with a supply flow at values comprised between 1 and 8 kg/h, wherein:

thermal spraying is high velocity fuel-air thermal spraying wherein the fuel is materialized in propane with a pressure comprised between 593 and 614 kPa, air is applied at a pressure comprised between 552 and 579 kPa, nitrogen and hydrogen are applied at a pressure of the order of 496 kPa, using a nitrogen flow rate of the order of 23 l/min, and a hydrogen flow rate of the order of 15 l/min, setting the pressure of the combustion chamber at about 496 kPa, the carrier gas is nitrogen, with a flow rate comprised between 20 l/min and 30 l/min, the propane pressure is at least 14 kPa above air pressure, the distance between the gun and the mill roll to be coated is comprised between 19 cm and 26 cm, the transverse speed of the spraying gun is comprised between 2 and 3 mm/s; having envisaged that the linear movement of the mill roll moves at a speed of between 2000 mm/s for diameters less than 500 mm, 2500 mm/s for diameters comprised between 200 and 500 mm and 3000 mm/s for diameters less than 200 mm.

2. The method for obtaining rolling mill rolls with a coating of tungsten carbide alloy according to claim 1, characterised in that a final polishing step using diamond abrasive is additionally established.

3. The method for obtaining rolling mill rolls with a coating of tungsten carbide alloy according to claim 1, characterised in that a phase or step b) for activating the surface by blasting is additionally established.

4. The method for obtaining rolling mill rolls with a coating of tungsten carbide alloy according to claim 1, characterised in that two additional operational steps or phases are established; a step e) wherein a surface cleaning process is carried out by means of heating, and a step f) wherein the roughness peaks are rounded by spraying glass beads.

5. The method for obtaining rolling mill rolls with a coating of tungsten carbide alloy according to claim 1, characterised in that in step f) air is applied at a pressure comprised between 483 and 552 kPa, while the combustion chamber will be kept at a pressure of the order of 262 kPa, with the particularity that the glass microspheres exhibit a composition based on sodium-calcium glass without free silica and chemically neutral, with a spherical and regular shape, non-porous, with a hardness comprised between 48-50 HRc and a granulometry comprised between 45-90 μm.

6. A rolling mill roll with a coating of tungsten carbide alloy, characterised in that the coating is a single layer, with a thickness comprised between 0.003 mm and 0.020 mm, and which affects 100% of the work surface, and has a gas permeability comprised between 0% and 0.1%, and that the tungsten carbide alloy comprises molybdenum borides or chromium carbides.

* * * * *